US011441442B2

(12) United States Patent
Jouy et al.

(10) Patent No.: US 11,441,442 B2
(45) Date of Patent: Sep. 13, 2022

(54) DEVICE FOR SEALING BETWEEN A ROTOR AND A STATOR OF A TURBINE ENGINE

(71) Applicant: SAFRAN AIRCRAFT ENGINES, Paris (FR)

(72) Inventors: Baptiste Marie Aubin Pierre Jouy, Moissy-Cramayel (FR); Josselin Luc Florent Sicard, Moissy-Cramayel (FR); Mathieu Charles Jean Verdiere, Moissy-Cramayel (FR); Loïc Fabien François Villard, Moissy-Cramayel (FR)

(73) Assignee: SAFRAN AIRCRAFT ENGINES, Peris (FR)

( * ) Notice: Subject to any disclaimer, the term of this patent is extended or adjusted under 35 U.S.C. 154(b) by 6 days.

(21) Appl. No.: 16/608,103

(22) PCT Filed: Apr. 24, 2018

(86) PCT No.: PCT/FR2018/051022
§ 371 (c)(1),
(2) Date: Oct. 24, 2019

(87) PCT Pub. No.: WO2018/197800
PCT Pub. Date: Nov. 1, 2018

(65) Prior Publication Data

US 2020/0095882 A1 Mar. 26, 2020

(30) Foreign Application Priority Data

Apr. 24, 2017 (FR) ..... 1753535

(51) Int. Cl.
*F01D 11/12* (2006.01)
*F01D 11/02* (2006.01)

(52) U.S. Cl.
CPC ..... *F01D 11/122* (2013.01); *F01D 11/02* (2013.01); *F05D 2240/55* (2013.01); *F05D 2250/283* (2013.01); *F05D 2300/611* (2013.01)

(58) Field of Classification Search
CPC ..... F01D 11/02; F01D 11/08; F01D 11/12; F01D 11/122; F01D 11/127; F01D 5/225;
(Continued)

(56) References Cited

U.S. PATENT DOCUMENTS 4,351,532 A * 9/1982 Laverty ..... F16J 15/4472 277/419
5,218,816 A * 6/1993 Plemmons ..... F01D 11/02 277/419

(Continued)

FOREIGN PATENT DOCUMENTS

EP 2 650 476 A2 10/2013
JP 2009 047043 A 3/2009
JP 2012 002234 A 1/2012

OTHER PUBLICATIONS

International Patent Application No. PCT/FR2018/051022, International Search Report and Written Opinion dated Jul. 24, 2018, 10 pgs. (relevance in citations and English translation of ISR).

*Primary Examiner* — Brian P Wolcott
(74) *Attorney, Agent, or Firm* — Lathrop GPM LLP

(57) ABSTRACT

A sealing device between a rotor part and a stator part, including at least one abradable coating cooperating with at least two upstream and downstream labyrinth seal lips. Axially upstream of the labyrinth seal lips, the sealing device includes a circumferential wall that radially extends beyond the upstream free axial sealing surface of the coating to create, at the free end of the upstream labyrinth seal lip, a separation of the circulating gas.

16 Claims, 5 Drawing Sheets

Figure 1:
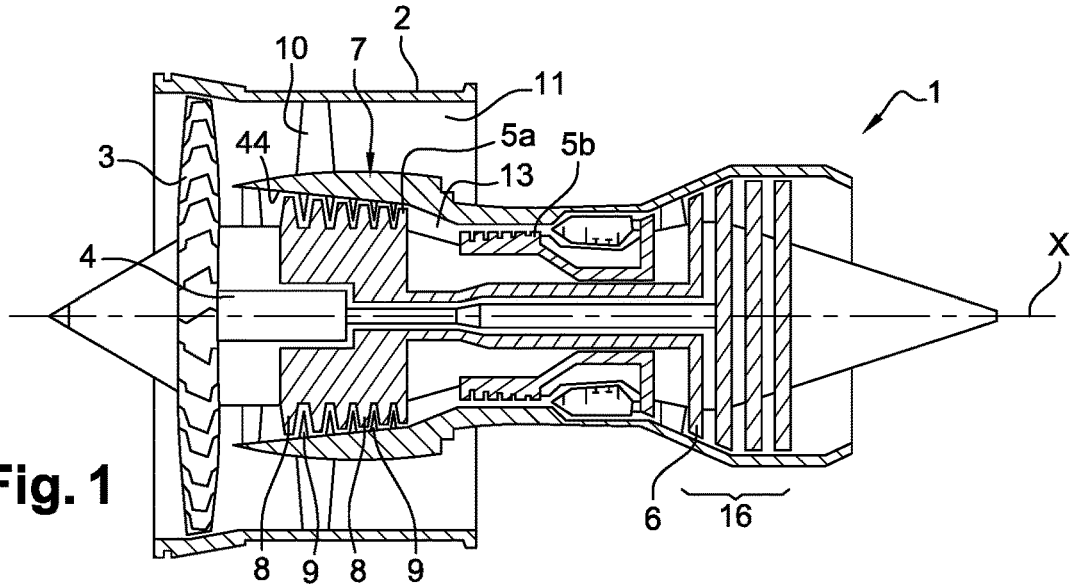

(58) Field of Classification Search
CPC ..... F05D 2240/55; F05D 2250/283; F05D 2300/611
See application file for complete search history.

(56) References Cited

U.S. PATENT DOCUMENTS

| | | | | |
|---|---|---|---|---|
| 5,639,095 | A * | 6/1997 | Rhode | F16J 15/4472 277/303 |
| 7,255,531 | B2 * | 8/2007 | Ingistov | F01D 5/225 415/173.1 |
| 8,807,927 | B2 * | 8/2014 | Babu | F01D 11/122 415/173.5 |
| 9,080,459 | B2 * | 7/2015 | Chouhan | F01D 11/127 |
| 9,151,174 | B2 * | 10/2015 | Chouhan | F01D 11/08 |
| 9,291,061 | B2 * | 3/2016 | Chouhan | F01D 5/225 |
| 2008/0075600 | A1 | 3/2008 | Moors et al. | |
| 2009/0067997 | A1 | 3/2009 | Wu et al. | |
| 2011/0070074 | A1 * | 3/2011 | Schabowski | F01D 11/08 415/174.5 |

* cited by examiner

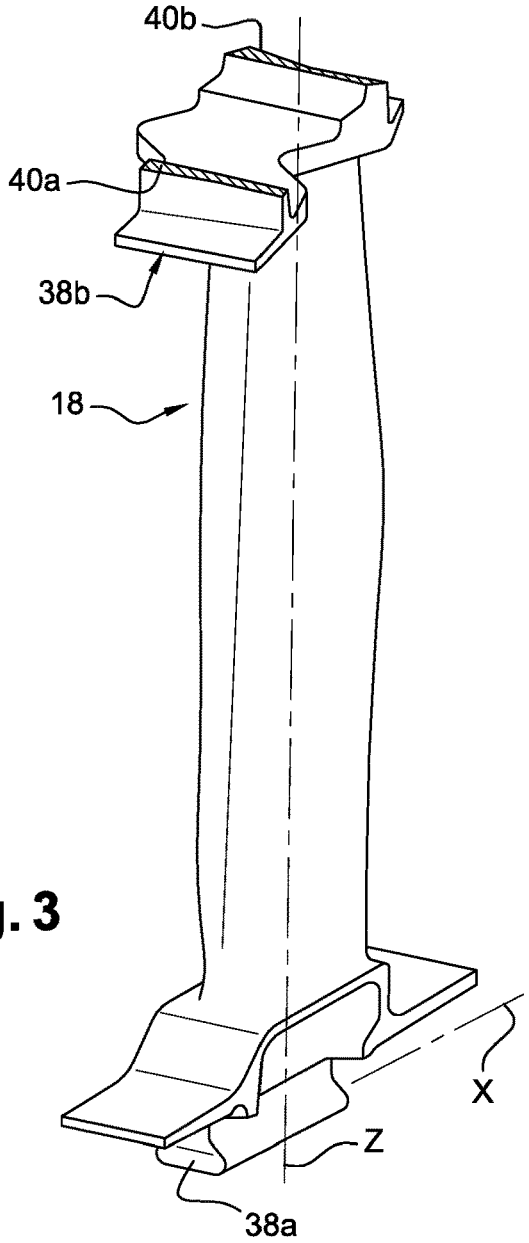
Fig. 3
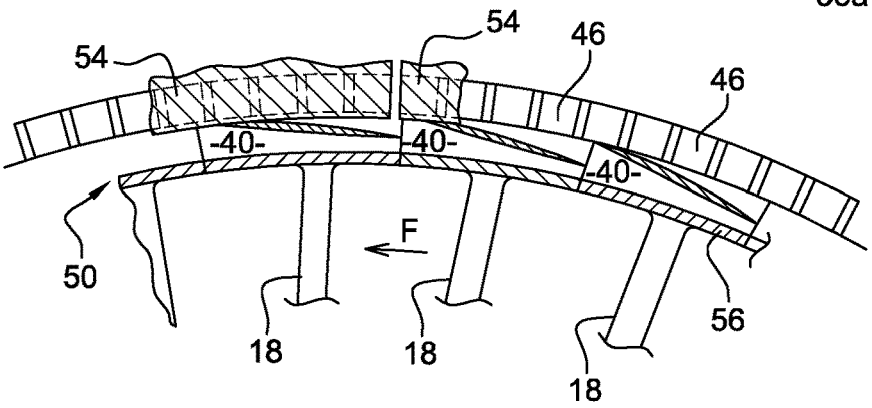
Fig. 4
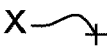

DEVICE FOR SEALING BETWEEN A ROTOR AND A STATOR OF A TURBINE ENGINE

CROSS-REFERENCE TO RELATED APPLICATIONS

This application is a 35 U.S.C. § 371 filing of International Application No. PCT/FR2018/051022 filed Apr. 24, 2018, which claims the benefit of priority to French Patent Application No. 1753535 filed Apr. 24, 2017, each of which is incorporated herein by reference in its entirety.

This invention relates to a sealing device between a rotor part and a stator part of an aircraft gas turbomachine wherein gas is to flow.

In the present application:

- radial means (substantially) perpendicular to the X axis mentioned hereunder,
- circumferential means extending about the X axis; Y direction in FIG. 8,
- "outer" and "inner" (or "external" and "internal") respectively mean radially outer and radially inner, and
- labyrinth seal lip will also be often translated by: «rubbing strip (seal)» or «knife».
- axial means a direction parallel to the axis of rotation, in particular of the blades of the turbomachine; this is thus the X axis already mentioned, and
- "upstream" and "downstream" are axial positions with reference to the general direction of movement of gas in the turbomachine.

Traditionally, the stator part comprises an outer casing inside which are circumferentially attached, as part of the sealing system, blocks of abradable material defining radially inner coatings adapted to cooperate with rotor blade labyrinth seal lips that can rotate about an axis (X), inside the outer casing. Such turbomachine outer walls with abradable inner coatings can in particular be defined by a compressor or turbine casing, or ring.

In addition, a stator part typically also includes blocks of abradable material that can define radially inner coatings of stator stationary blade shrouds (or distributors) adapted to cooperate with labyrinth seal lips.

However, relative movements between the blades and the casings occur as a result of thermal and aerodynamic stresses.

In order to ensure the best possible efficiency of the turbomachine, it is therefore essential to limit gas leaks that occur between the moving blades of a rotor part, or the stationary blades of a stator part, typically at the location of the above-mentioned labyrinth seal lips, and the abradable material coating opposite. The typically labyrinth seal lips or sealing devices, consisting of the labyrinth seal lips and the blocks or coatings made of abradable material aim at preventing or limiting such leakages by opposing the axial passage of gas in the downstream direction, as long as the gas by-passing the rotating blades do not take share in the turbine work.

In fact, rotor/stator sealing control is an essential element of the performance of a low or high pressure (BP/HP) turbine of a turbomachine as mentioned above and is typically ensured on the one hand by the LPTACC or HPTACC (Low Pressure, or high pressure) system, Turbine Active Clearance Control Valve), which reduces radial rotor/stator clearance, and on the other hand by the labyrinths provided at the top of the blades and on intermediate rings, opposite the valves that create the seal for a given radial clearance.

However, the effectiveness of these labyrinth seal lips is not optimal and depends on several parameters such as their number, thickness, and staging. In addition, potentially excessive radial clearance persists due to, among other things, part manufacturing tolerances.

As a result, the gas flow through the rotor/stator sealing areas remains significant, although various imperfect technological proposals have so far been developed, notably on the basis of a configuration called "staged slopes".

A purpose of the invention is to avoid these situations.

Therefore, a sealing device is proposed between a rotor part and a stator part of an aircraft gas turbomachine wherein gas must flow in the downstream direction, the rotor part being adapted to rotate relative to the stator part about an axis (X), the sealing device comprising at least one coating of abradable material:

- attached to the stator part,
- and adapted to cooperate with at least two, respectively axially upstream and downstream labyrinth seal lips, projecting radially over an extreme portion of the rotor part, the coating and said at least two labyrinth seal lips having radially, respectively, at least two respectively axially upstream and downstream, free axial sealing surfaces, and respective free ends, the free end of the downstream labyrinth seal lips and the downstream free axial sealing surface being located at radial positions (radially facing) which are each further from the axis (X) than the free end of the upstream labyrinth seal lips and than the upstream free axial sealing surface (radially facing), the device being characterized in that axially upstream of said at least two labyrinth seal lips with respect to the direction of gas flow in this zone of the turbomachine, the sealing device comprises a circumferential wall which radially extends beyond the upstream free axial sealing surface of said coating, penetrating radially into the gas flow, thus forming a substantially transverse obstacle to the flow of gas from upstream, to create, at the free end of the upstream labyrinth seal lip, a separation of the gas in circulation.

Compared to a configuration without this combination of characteristics, and therefore in particular compared to a solution with axial surfaces of the coating all located on the same radius (called "straight"), a substantial sealing gain is obtained by the above-mentioned staging and said circumferential wall which, by forming a low wall, penetrates radially into the gas flow. This makes it possible to create a favourable separation of the flow, even towards the end of the upstream labyrinth seal lip. This results in a smaller leakage cross-section than with any other form of labyrinth seal lips/coating sealing surfaces pairs, and a gain in the by-passed gas flow rate.

However, it was found that there may be practical problems in implementing the above solution, related to the thermal and aerodynamic conditions encountered, given the multiple situations that may exist on the ground and in flight.

It is therefore proposed, in particular to promote an optimized positioning:

- that, radially, said wall, or low wall, should still extend to face axially a part of the upstream labyrinth seal lip located radially at a distance from the free end of said upstream labyrinth seal lip, and/or
- that said circumferential wall should be axially located at or towards an axially upstream end of the upstream free axial sealing surface of the coating, and/or,
- that, from the free axial sealing surface upstream of the coating, this circumferential wall should extend over a radial distance greater than or equal to 1.5 mm, and/or that, from the same upstream axial sealing surface of said coating, said circumferential wall should radially extend over a radial distance of preferably between 1.25 mm and 5 mm, and/or that certain reports should be conformed to see below: $1 \leq D1/D2 \leq 1.5$, $$1 \leq L2/L1 \leq 4, 1 \leq L3/L1 \leq 3.$$

Tests have shown an increase in pressure drop (and therefore leakage) of about 10% compared to a solution as mentioned above, with free axial sealing surfaces of the coating all located on the same radius (called "straight"), and without a circumferential wall forming a low wall.

For considerations also comparable to the above, and even though most of the energy dissipation that is sought to be generated by the separation at the end of the upstream labyrinth seal lip occurs below the labyrinth seal lip(s), it is also proposed for an application at the top of rotating blades, and therefore of the rotor:

that the extreme portion of the rotor part on which said at least two labyrinth seal lips radially project should comprise a blade platform provided at the upstream end with an upstream-facing spoiler, and that, radially, said circumferential wall should extend opposite, but at a distance, from the spoiler.

Thus, said circumferential wall will be both sufficiently upstream of the upstream labyrinth seal lip, thus preventing the risk of contact during movements due to the above-mentioned thermal and aerodynamic conditions, and radially interposed between two formed gas flow guide surfaces:

by the spoiler (which will typically extend upstream beyond said circumferential wall), and by the upstream free axial sealing surface of the coating which extends downstream of this circumferential wall.

Another consideration taken into account is the ease of series production, assembly and maintenance (replacement) of this circumferential wall.

Therefore, it is also proposed:

that said circumferential wall should be defined by a superelevation formed on said coating, radially projecting from the upstream free axial sealing surface of said coating, and/or that this wall should be integral with said coating.

For similar reasons, it is also proposed that:

the coating should have a cellular structure comprising radial cells individually having an axial dimension, and that the circumferential wall should have an axial thickness greater than said axial dimension of the cells located on the same circumference, transversely to said axis (X).

This will combine mechanical strength and reliability with ease of assembly and maintenance.

Yet another consideration taken into account concerns the optimization of the creation of flow separations at the end of the upstream labyrinth seal lips.

Therefore, it is also proposed:

that at least the upstream labyrinth seal lip, in the direction of the upstream free axial sealing surface, should be inclined in the upstream direction with respect to the axis (X) and to a radial to the axis, over at least a part of its length, or that the free end of the upstream labyrinth seal lip should be located radially opposite an axially upstream part of the upstream free axial sealing surface.

The second consideration makes it possible to take advantage, over a significant axial length at the end of the coating, of the radial effect of separation on the gas flow.

It is also proposed that said at least two respectively axially upstream and downstream axially free axial sealing surfaces, should have a radial connection wall between them (i.e. perpendicular to the X axis).

It has been found that in terms of ease of manufacture and mechanical strength, such a radial connection wall is preferable here to a bias configuration, as in US2009067997 (walls 112).

The invention also relates to an aircraft gas turbomachine as such, characterized in that it is equipped with the sealing device with all or part of its above-mentioned characteristics.

Figure 2:
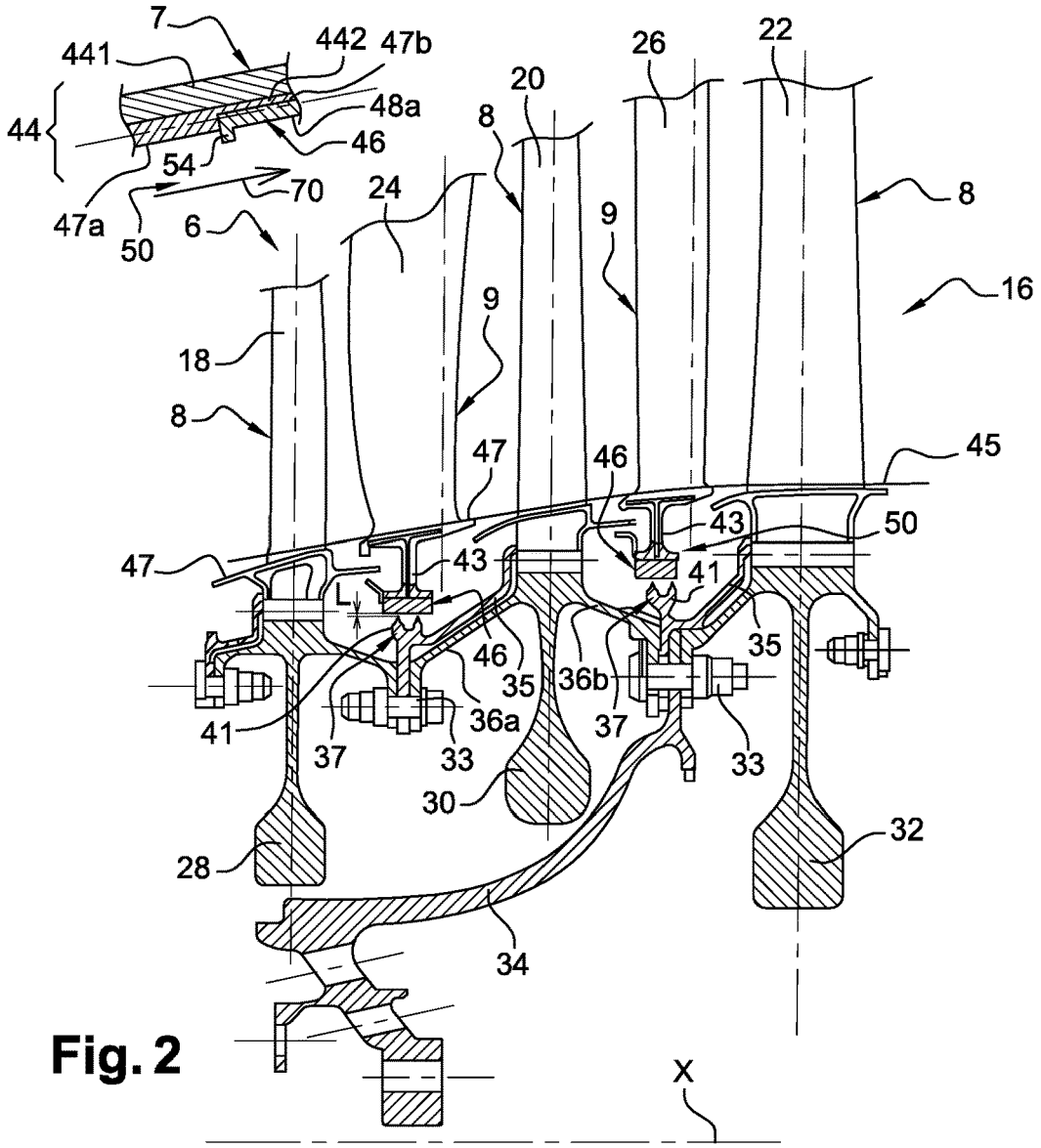
Figure 5:
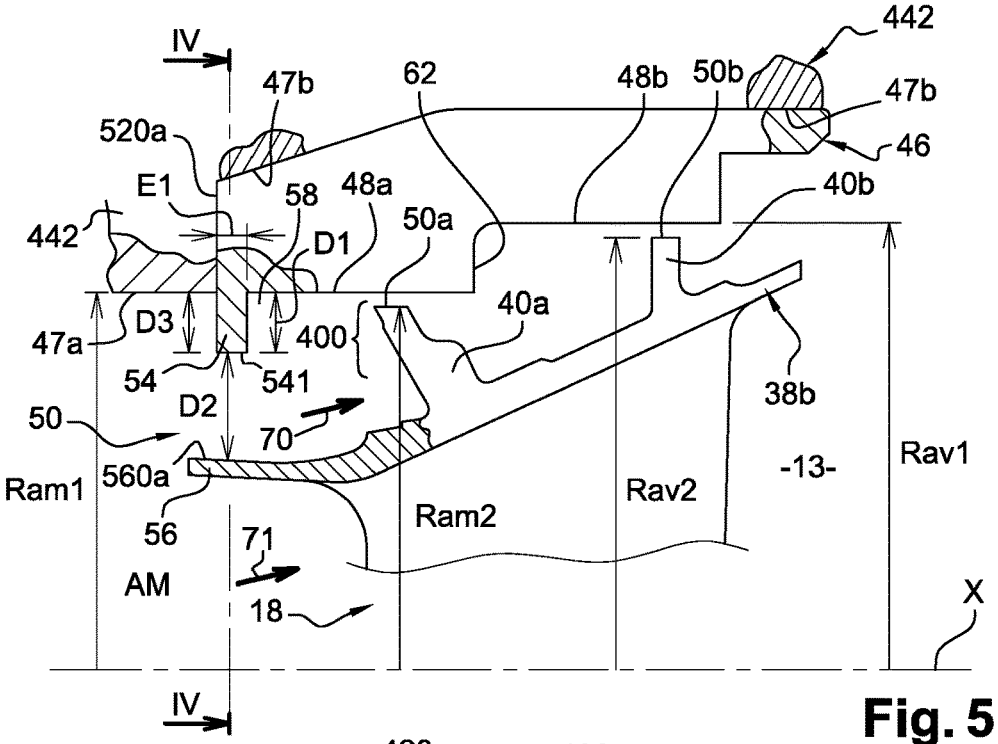
Figure 6:
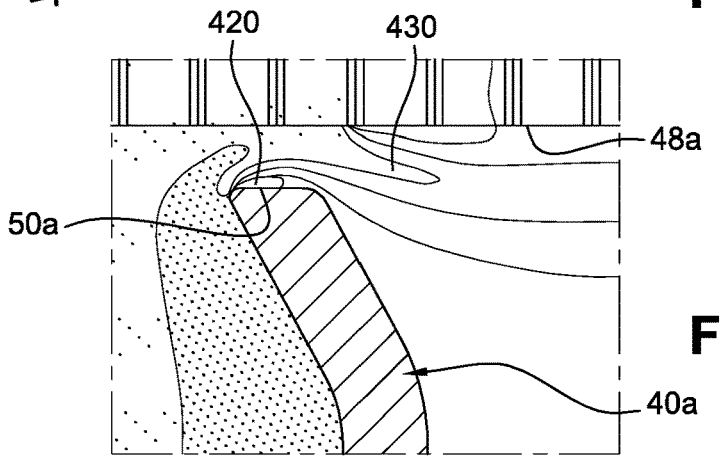
Figure 7:
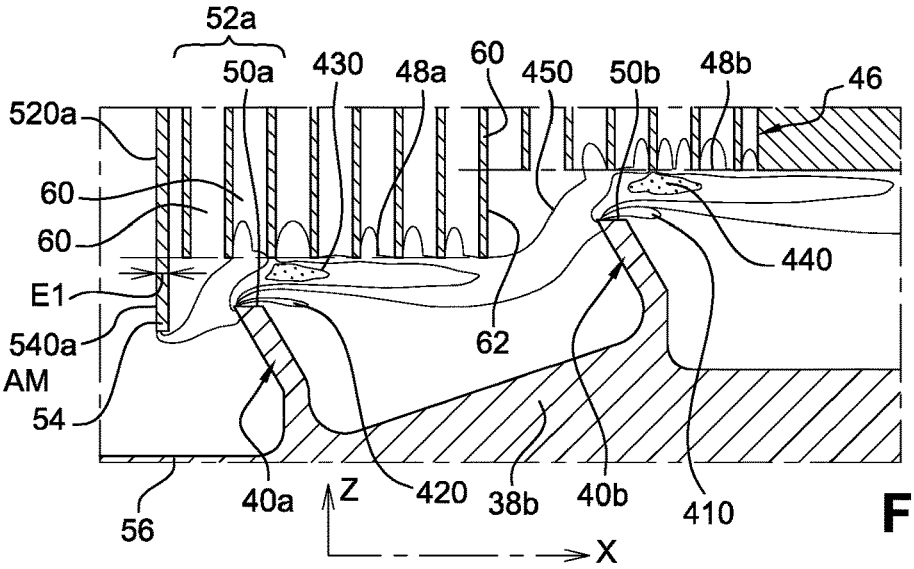
Figure 8:
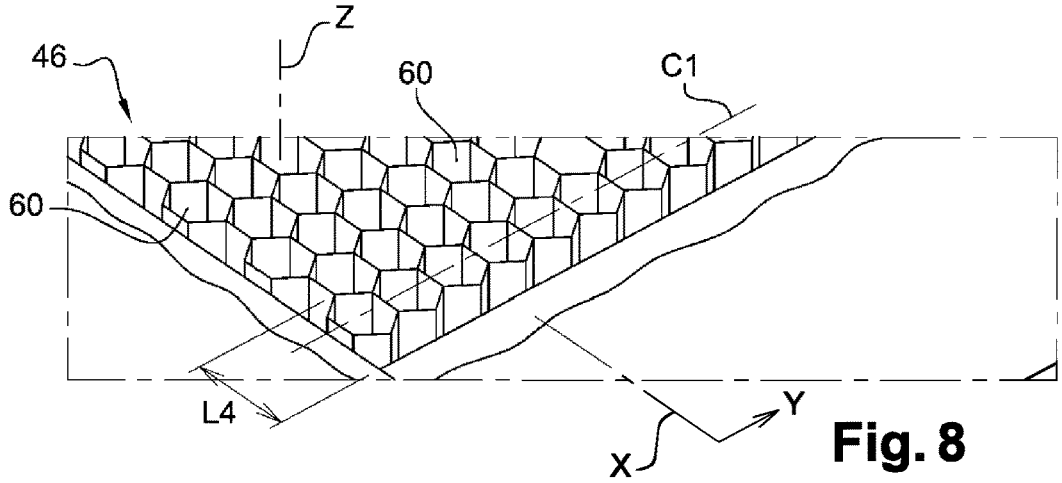
Figure 9:
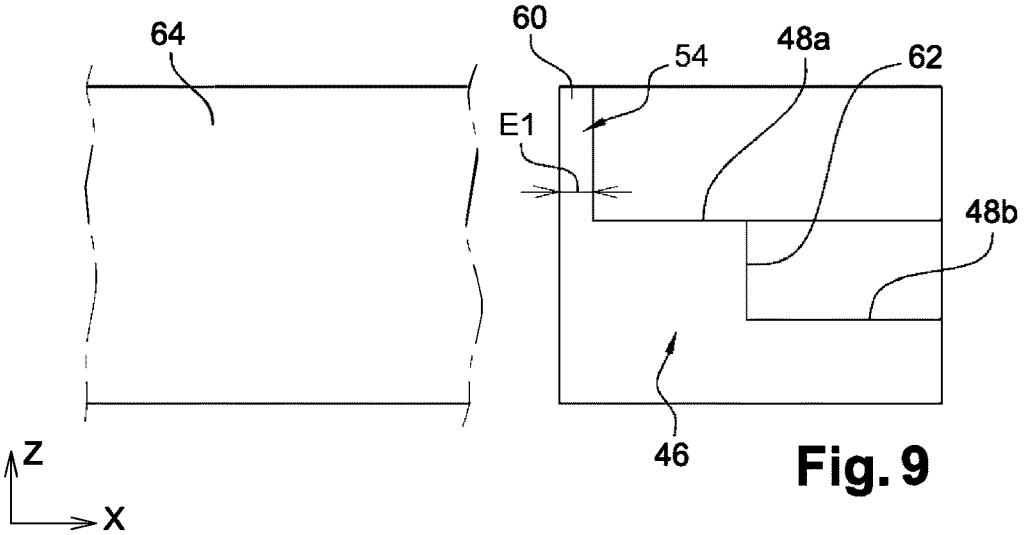
Figure 10:
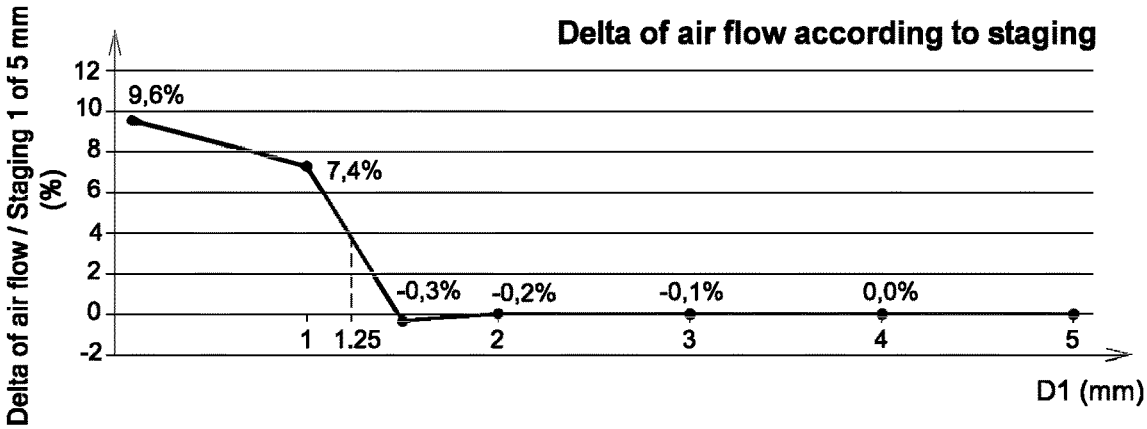
Figure 11:
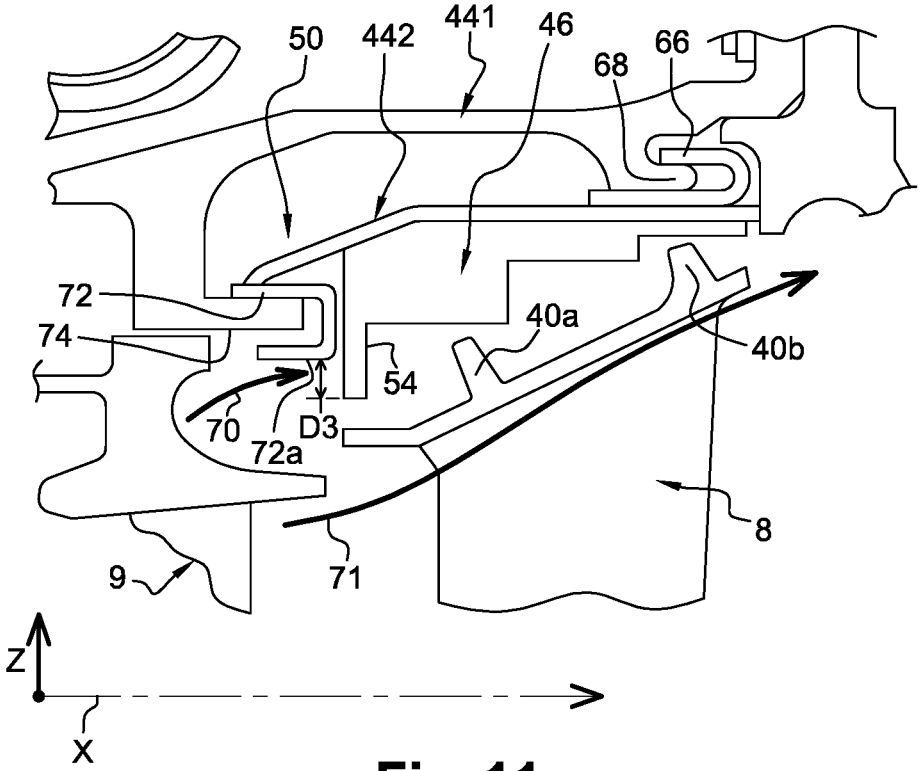
Figure 12:
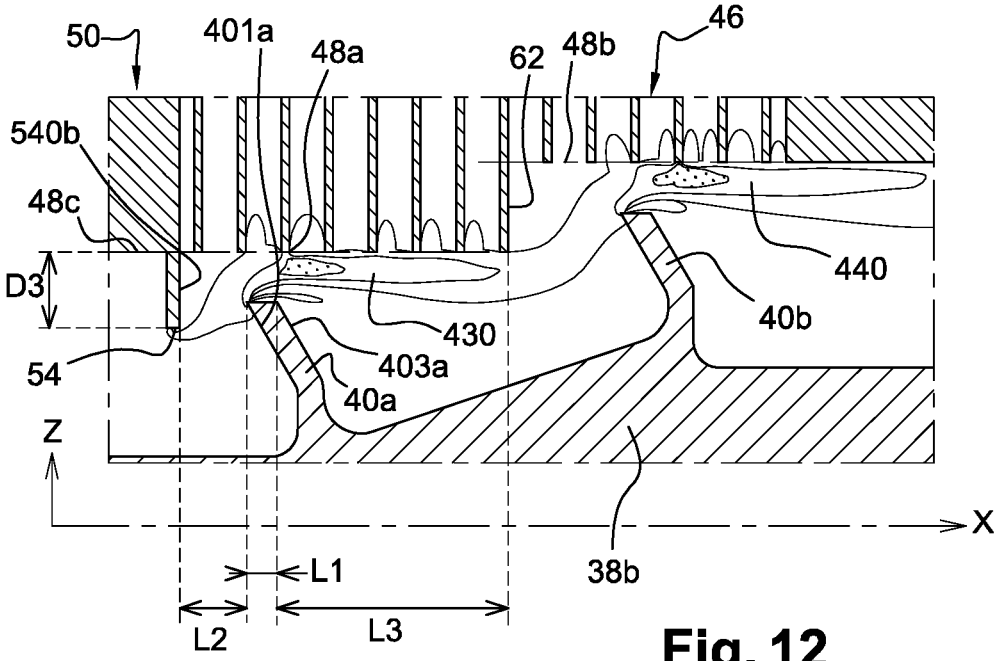

The invention will, if necessary, be better understood and other details, characteristics and advantages of the invention will become apparent upon reading the following description as a non-exhaustive example with reference to the appended drawings wherein:

FIG. 1 is a schematic partial and axial section of a part of the turbomachine as mounted on an aircraft;

FIG. 2 shows, following the same vertical section along a median plane containing the X axis, a part of the low-pressure turbine that can be fitted to the turbomachine in FIG. 1, FIG. 3 shows, in perspective, a rotating blade (rotor) that can be fitted to the turbine in FIG. 2, FIG. 4 is a vertical section according to line IV-IV of FIG. 5, at the level of moving blades of a turbine stage to be placed in the outer casing receiving them, FIG. 5 shows in axial partial section a cooperation between an abradable coating and an end of said moving blade;

FIG. 6 shows a total pressure field under an upstream labyrinth seal lip in a test thus mounted (the generated separation is clearly visible), FIG. 7 shows a more realistic mounting, with also such energy fields, FIGS. 8, 9 show, in perspective and side views a block of abradable material that can be used, FIG. 10 illustrates the performance gain related to the implementation of the circumferential wall proposed by the invention, i.e. a maximum 10% reduction in leakage rates, and FIGS. 11 and 12 illustrate two variants of the sealing system, in accordance with the invention.

As shown in the schema of FIG. 1, a turbofan engine or turbojet engine 1 for an aircraft comprises at least one annular fan casing or outer circumferential enclosure 2 inside which various components of the turbomachine are positioned.

Blades of a fan 3 coupled to a rotating shaft 4 are positioned at the inlet of the annular outer casing 2, taking account of the air motion direction (which is opposite the aircraft flying direction, refer to the arrow in FIGS. 1, 2). Then, connected to the shaft 4, which extends around the X axis of rotation of the turbomachine, are different axial compression stages, typically a low-pressure compressor 5*a* followed by a high-pressure compressor 5*b*. Then are arranged various other engine components including axial turbine stages, typically a high pressure turbine 6 followed by a low pressure turbine 16.

Air enters the annular outer fan casing 2 where it is driven by the fan blades 3. To provide propulsion, the largest part thereof flows in the secondary jet 11 radially delimited between a section of the annular outer casing 2 and an engine casing 7 located further inside. Another part of the air is sucked into a primary jet 13 (the flow 71 in the downstream direction, in FIGS. 5 et 11) by the low pressure compressor 5*a* and oriented towards the stages of the turbine 6 by other elements which compose the engine. Besides, stiffening arms 10 connect the annular outer casing 2 and the engine casing 7.

Each compressor, such as the low pressure compressor 5*a* in FIG. 1, comprises a turning or rotating section and a stationary section integral with one engine casing 7. More specifically, the compressor comprises alternating blades 8 which belong to rotor wheels, coupled with the shaft 4, and thus rotating, and downstream guide vanes 9 (or stators) coupled with the stationary section of the compressor, in order to guide air.

Since the "circumferential wall" mentioned above can in particular be provided on a low-pressure turbine, FIG. 2 shows an example of such a turbine which axially comprises several rows of moving blades 18, 20, 22 (blades 8) and stationary blades 24, 26 (downstream guide vanes 9), alternately.

The radially external ends of the stationary blades 24, 26 are mounted by means (not shown) on a casing of the engine 7 and the radially internal ends of the rotating blades 18, 20, 22 are mounted, for example using dovetail means or similar, at their radially internal ends, on rotor disks 28, 30, 32. Each disk comprises an upstream annular flange 36*a* and a downstream annular flange 36*b* used for attaching disks together and on a driving cone 34 connected to the shaft 4 of the turbomachine, so as to rotate therewith, and for attaching annular flanges holding the blade roots on the disks. The blade roots are so designed as to cooperate with axial grooves provided in the rotor disks. Each rotating blade extends along an axis perpendicular to the axis X of the rotor whereon the blade is mounted.

Two axially successive rotor discs, such as 28.30, are joined together via the above-mentioned upstream and downstream annular flanges by bolts 33 which also hold an intermediate sealing ring 35 bearing an inter-stage seal 37 and located on the outer periphery of the corresponding upstream flange 36*a*. Such seal, known per se, may comprise radial annular extensions or labyrinth seal lips 41 cooperating with a coating 46 made of abradable material so as to define a rotor/stator sealing system.

Generally speaking, the rotor blades are positioned, and can rotate, about the axis X, between an outer annular boundary 44 and an inner annular boundary 45 which can substantially be defined by inner 47 platforms, which are provided on the rotating blades and the stationary downstream guide vanes. FIG. 2, each coating 46 is attached to the radially inner shroud 43 of the corresponding inner platform 47.

FIG. 3 shows an example of a rotor blade, such as 18, which may belong to the first low-pressure turbine wheel.

Each moving blade has a blade foot 38*a* at its inner end and the outer platform 38*b* towards its outer peripheral end. The blade extends along a blade axis Z perpendicular to the axis X of the rotor whereon said blade is mounted.

Like the labyrinth seal lips 41 in FIG. 2, respectively axially upstream and downstream labyrinth seal lips 40*a*,40*b* are provided here.

All the labyrinth seal lips 40*a*,40*b*,41 are arranged in planes substantially perpendicular to the axis of rotation X of the rotor and extend in a substantially annular manner.

As for the labyrinth seal lips 41, we therefore find here, by bringing together FIGS. 2 and 3, at least two labyrinth seal lips 40*a*,40*b* carried by an extreme portion, here 38*b*, of a rotor part and from which the labyrinth seal lips here projects radially outwards. These labyrinth seal lips are adapted to cooperate with a coating made of abradable material 46 attached, a priori indirectly, to the inner wall of a fixed outer casing 441 belonging to the above-mentioned outer annular boundary 44, to form a labyrinth seal, and thus define a sealing device 50. Typically, this is done via ring sectors 442 that are circumferentially hooked on the outer casing 441.

The blocks 46 of abradable material typically extend in angular sectors, circumferentially, around the X axis.

Although the following refers in particular to FIG. 5, all rotor/stator sealing areas involving abradable materials, in particular between the labyrinth seal lips 41 and the coatings 46 of the shrouds 43, are concerned since:

- the coating 46 will have at least two respectively axially upstream and downstream radially free axial sealing surfaces, 48*a*,48*b*
- said at least two labyrinth seal lips, such as 40*a*,40*b* here, will have respective radially free ends, 50*a*,50*b* and
- the free end 50*b* of the downstream labyrinth seal lip 40*b* and the downstream free axial sealing surface 48*b:*
  - will be located at radial positions facing each other radially and
  - will each be (respective radii Rav2,Rav1 see FIG. 5) further from the X axis than the free end 50*a* of the upstream labyrinth seal lip 40*a* and than the upstream free axial sealing surface 48*a*, which will face radially (respective radii and Ram2,Ram1).

Indeed, this contributes to a significant reduction (5 to 15% a priori) in the by-passed gas flow, which will then not pass through the sealing zone concerned, especially if, as shown in FIGS. 5 and 7, it is associated with at least one upstream 40*a* labyrinth seal lip which, towards said upstream free axial sealing surface, is inclined upstream (AM) with respect to the axis (X) and a radial to the axis, over at least part of its projecting length. In FIG. 7, the two labyrinth seal lips 40*a*,40*b* are inclined in the upstream direction. And it can be seen that the free end 50*a* of the upstream labyrinth seal lip 40*a* is located radially opposite an axially upstream part 52*a* of the upstream free axial sealing surface 48*a* of the abradable coating 46. This must make it possible to take advantage, over a significant axial length at the end of the coating, of the radial effect of the separation of the gas flow created by the circumferential wall 54 provided axially upstream of the labyrinth seal lips and which radially extends beyond the upstream free axial sealing surface 48*a* of the coating 46 considered. Since it is circumferential, the low wall 54 can be extended by angular sectors around the X axis.

Overall, such a double obstacle, with a stepped abradable material and radially offset and inclined labyrinth seal lips at least for the upstream labyrinth seal lip, makes sense anyway.

FIGS. 6 and 7 show the separation, referenced 420, of this gas flow created by the circumferential wall 54 at the end 50*a* of the upstream labyrinth seal lip.

By adding a resistant, a priori solid, wall 54 upstream of the sealing zone, which creates a substantially transverse obstacle to the circulation of gas upstream of this zone, it will be possible to obtain a significant energy dissipation phenomenon, referenced 430,440, just downstream of the ends of the various rows of labyrinth seal lips.

And it is the circulation caused between the two labyrinth seal lips 40*a*,40*b* by the wall 54 that will create conditions favourable to the separation 410 at the end of the downstream labyrinth seal lip. The example in FIG. 7 shows this.

FIGS. 2 and 5 show the projection defined by this low wall 54 with respect to the (substantially) axial free surfaces, here 47*a* and 48*a*, which radially limit the inter-space 70 of the circulating gas flow. The low wall or wall 54 is thus formed in the gaseous inter-space 70 adjacent to the primary jet 13 and located radially between the abradable material 46 and the top of the blade 18 concerned. As noted, the free surfaces 47*a* and 48*a* belong to the outer annular boundary 44, the free surfaces 47*a* and 48*a* are axially located on either side of said low wall 54 respectively.

It can also be seen that in addition to the upstream (substantially) axial free surface 47*a*, that of the ring sectors 442 which is located axially (axis X) just upstream of the low wall 54 considered has a downstream (substantially) axial free surface 47*b*. The free surfaces 47*a* and 47*b* respectively extend, adjacent to each other, upstream and downstream of the low wall 54; and this low wall 54 (at least its (substantially) free axial surface 541) is radially (Z axis) projecting towards the upstream (substantially) free axial surface 47*a* and the downstream (substantially) free axial surface 47*b* of the ring sector 442 considered.

As shown in FIG. 4, each wall 54 can, like the stator part that includes it, extend in a plane perpendicular to the axis of rotation X and this annularly, by angular sections.

Including to preserve the integrity of the/each wall 54 with regard to part movements due to the above-mentioned thermal and aerodynamic conditions, it is recommended that this wall 54 should be located axially at or towards an axially upstream end 520*a* of the upstream free axial sealing surface of the coating 46, upstream of the above-mentioned zone 52*a*.

As shown in the figures, with regard to the two upstream 48*a* and downstream 48*b* free sealing surfaces, the wall 54 will a priori be unique, in the sense that it is located just upstream, or at the upstream end, of the upstream free sealing surface 48*a*, since no other such radially projecting low wall exists downstream on the sealing device 50, particularly on the abradable material 46, and in particular on the downstream free sealing surface 48*b*.

The separation 420 and the schematic representations of turbulent kinetic energy in 430 and 440 (see FIG. 6 or 7) clearly show that the wall 54 defines, or forms, a flow disturbance in the inter-space 70 and that the upstream face 540*a* of this low wall is arranged to be opposite this flow, thus substantially along the Z axis. In the preferred example shown, the upstream face 540*a* and the axially upstream end 520*a* are the radial extension of each other.

To promote the phenomenon of energy dissipation that is sought to be generated by the separation at the end of the upstream labyrinth seal lip, it is also proposed that the wall 54 should still radially extend to axially face a part 400 of the (each) upstream labyrinth seal lip 40*a* located radially at a distance from the free end 500*a* of this labyrinth seal lip see in particular FIG. 5.

Without a circumferential wall 54, the direction of the jet would remain (more) axial and pass the end of the upstream labyrinth seal lip 40*a* with no significant separation. In a way like a low wall, the wall 54 modifies the flow topology. The gas jet has a more radial direction which induces a much more important separation when passing this upstream labyrinth seal lip. The leakage section being closed by the separation, the energy dissipation is therefore increased, which is favourable to the desired sealing. We could thus see (as FIG. 7) that the turbulent kinetic energy is maximum in the vicinity of a downstream labyrinth seal lip, and therefore more important than in the vicinity of an upstream labyrinth seal lip.

If necessary in combination with the above feature, it is also recommended, in particular to promote an optimized positioning:

- that, from the upstream free axial sealing surface 48*a* of the coating 46, the circumferential wall 54 should extend over a radial distance D1 greater than or equal to 1.5 mm, or
- that, from this same upstream free axial sealing surface 48*a* of said coating, said circumferential wall 54 should extend radially over a radial distance D1 of preferably between 1.25 mm and 5 mm.

FIG. 10, it can also be seen that in one embodiment such as that of FIG. 5 tested with a radial wall 62 of connection between two respectively upstream 48*a* and downstream 48*b* free axial sealing surfaces, 5 mm high (staging 1), the curve of evolution of the ratio in % of the delta of air flow circulating in the inter-space, in zone 70, between the abradable material 46 and the top of the blade 18 concerned, according to the height D1 is levelled off at 1.5 mm. Efficiency is more significant beyond this value. Beyond 5 mm, no additional gain is demonstrated, and problems of integration of the rotor into the turbine occur. Note that at a little less than 4% difference, a value D1=1.25 mm is acceptable, the efficiency being already significant.

It should also be noted that the following reports contribute to such performance, preferably in combination (see FIGS. 5 and 12 for identification of the distances involved):

$$1 \leq D1/D2 \leq 1.5, \text{ and/or}$$

$$1 \leq L2/L1 \leq 4, \text{ and/or}$$

$$1 \leq L3/L1 \leq 3.$$

These ratios favour the disruption of the flow, as can be seen with the presence of the two main high energy zones 430,440.

For confirmation:

- D1 which is the projection of the low wall 54, or the radial distance between the upstream free axial sealing surface 48*a* of the abradable coating 46 and the free end of the low wall 54,
  - D2 which is the radial distance between the free end of the low wall 54 and a radially outer face 560*a* of the spoiler 56 located in its radial continuity,
- L1 which is the axial thickness of the (each) upstream labyrinth seal lip 40*a*, at its free radial end,
- L2 which is the axial distance between a downstream face 540*b* of the low wall 54 and, located in its axial continuity, an upstream face 401*a* of the upstream labyrinth seal lip 40*a*, at its free radial end, and
- L3 which is the axial distance between the radial connecting wall 62 and, located in its axial continuity, a downstream face 403*a* of the upstream labyrinth seal lip 40*a*, at its free radial end.

These reports were confirmed as contributing to the above-mentioned additional energy dissipation, which is just over 10%.

For considerations comparable to the above, it is also proposed, for an application at the top of rotating blades, therefore of a rotor:

- that the platform 38*b* should be equipped at the upstream end with a spoiler 56 facing upstream, and
- that, radially, said circumferential wall 54 should extend opposite, but at a distance from the spoiler.

Such a distance D2 of more than 20 mm is recommended.

To facilitate series production, assembly and maintenance of the circumferential wall 54, it is also recommended:

that this wall 54 should be defined by a superelevation 58 formed on the considered coating 46, projecting radially from the upstream free axial sealing surface 48*a*, and that this wall 54 should be integral with said coating 46, as shown.

In particular, each abradable sealing coating can be formed into a honeycomb, with individually closed contour cells 60; see FIG. 8 where the X axis and the Y axis, transverse to the X and Z axes, are marked. The typically polygonal cells will be connected to each other to form a block, a part of which is illustrated in FIG. 8, in one embodiment. The radially open cells 60, individually have an axial dimension L4 (length), and the circumferential wall 54 has an axial thickness E1 greater than said axial dimension L4 of the cells (of each mesh) located on the same circumference C1, transverse to said X axis; see FIGS. 8.9.

If this is the case, mechanical strength and reliability can be combined with ease of assembly and maintenance.

Since the oblique, inclined connection walls (as in US2009067997/walls 112) impose machining constraints, it is also proposed that the at least two respectively axially upstream 48*a* and downstream 48*b*—free axial sealing surfaces should have a radial connection wall 62 between them (substantially perpendicular to the X axis in the example). The example of FIG. 7 also shows that the turbulent kinetic energy (or pressure) field when passing from a rotor/stator sealing zone designed with the above characteristics has two main high-energy zones 430.440, immediately downstream of the labyrinth seal lips 40*a*,40*b*, and is almost in contact with the respective surfaces 48*a*,48*b*. On the other hand, this energy/pressure field is weaker in the immediate environment of the right-hand step 62 (zone 450). The level of turbulent kinetic energy is representative of pressure losses, and therefore characterizes the effectiveness of the seal. The turbulent kinetic energy, already high in 430, is maximum here in 440, near the second labyrinth seal lip.

All this is in favour of limiting the by-passed gas flow.

In connection with the circumferential wall 54, the additional energy dissipation was estimated—by calculation—to be slightly higher than 10% compared to a solution without a circumferential wall and without staging or free surfaces of the coating or upstream and downstream labyrinth seal lips, it being understood that this gain can be obtained on each rotor/stator cooperation stage considered, as here of a turbine.

Technologically, several solutions can be considered to form the low wall 54 upstream of the sealing zone considered.

A relevant, simple to implement and effective solution is to supply relatively high raw plates 46 made of abradable material; direction Z FIG. 9 where the X/Z scales are not respected. Several machining operations are then used to create the low wall/wall 54 and the two stepped surfaces 48*a*,48*b*, here with the radial step 62, intermediate between them. Axially at least as thick (E1) as a cell 60 (L4) in order to ensure the continuity of said low wall (and the tightness of this wall 54), the circumferential wall 54 is itself perpendicular to the surfaces 48*a*,48*b*.

FIG. 11 shows a mounting, which may be more operational, of an abradable coating. In this solution, each of the circumferential blocks of abradable coating 46 is attached (e.g. welded or brazed) radially outward to one of the ring sectors 442. Each of these ring sectors is circumferentially attached to the outer casing 441. For this purpose, each ring sector 442 can be provided fixedly (e.g. welded to it) and radially outward:

towards the downstream end with at least one downstream hooked (or C-shaped) holding member 66, open in the upstream direction and (each) circumferentially engaged with a downstream circumferential rail 68, projecting downstream, of the outer casing 441 (or attached to it), and, towards the upstream end, with at least one upstream hooked (or C-shaped) holding member 72, open in the upstream direction and (each) circumferentially engaged with an upstream circumferential rail 74, projecting downstream, of the outer casing 441 (or attached to it).

In this case, it is the (substantially) free axial surface 72*a* of the (each) upstream holding member(s) 72 that will define said upstream free axial surface of the ring sector (referenced 47*a* in the embodiment of FIGS. 2 and 5).

As before, this upstream free axial surface 72*a* of the ring sector 442 is axially (axis X) immediately adjacent to the low wall 54 which projects radially therefrom. Thus, the downstream gas flow flowing through the interspace 70 sweeps over the (substantially) free axial surface 72*a* and then hits the transverse low wall 54 which is therefore (substantially) along the X axis adjacent to the surface 72*a*.

In another alternative, as shown in FIG. 12, the free axial surfaces on either side of the low wall. In this case, the upstream and downstream (substantially) free axial surfaces adjacent to the wall 54 are each formed by the abradable element of the ring sector 442 of the relevant impeller. Thus, the (each) abradable element 46 integrates, in addition to the low wall 54 and the upstream free axial surface 48*a*, another (substantially) free axial surface 48*c* located upstream of the low wall 54. To ensure its effect, the low wall 54 is radially projecting inwards with respect to said respectively upstream and downstream (substantially) free axial surfaces 48*c* and 48*a* adjacent to it.

From the above and the support of the illustrations, it will be understood that, in order to create, at the free end of the upstream labyrinth seal lip 40*a*, a separation of the gas in circulation, the low wall 54, defined by a superelevation on said coating 46, will therefore form:

a radial projection from an upstream free axial surface (47*a*,48*a*,48*c*,72*a*, above) of the sealing device 50 which is axially contiguous or adjacent thereto, in particular a radial projection with respect to an upstream free axial surface (47*a*,48*c*,72*a* above) of the sealing device 50 which is axially contiguous or adjacent thereto upstream thereof; see distance D3 in FIGS. 5,11,12.

The invention claimed is:

1. A sealing device arranged to cooperate with a rotor part and a stator part, both of an aircraft gas turbomachine in which a gas stream is to circulate from upstream to downstream, the rotor part being adapted to rotate relative to the stator part about an axis, the sealing device comprising:

two labyrinth seal lips, respectively an upstream one and a downstream one, both being elements of the rotor part; and, at least one block made of an abradable material:

attached to the stator part, and adapted to cooperate with said two labyrinth seal lips, each projecting radially to said axis over an end portion of the rotor part, the at least one block has, radially to said axis, a first upstream free axial sealing surface and a downstream free axial sealing surface, and said two labyrinth seal lips have, radially to said axis, respective free ends, the free end of the downstream labyrinth seal lip and the downstream free axial sealing surface being located at positions radial to said axis which are each further from the axis than the free end of the upstream labyrinth seal lip and the first upstream free axial sealing surface, wherein, upstream of said two labyrinth seal lips, the sealing device comprises a circumferential wall which extends radially to said axis upstream and adjacent to the first upstream free axial sealing surface of said at least one block, by penetrating radially to said axis into the gas stream, and wherein:

the sealing device further has a second upstream free axial sealing surface which is adjacent to said circumferential wall, upstream of the circumferential wall, and, the circumferential wall projects radially with respect to the first upstream free axial sealing surface and second upstream free axial sealing surface of the sealing device, and wherein said first upstream free axial sealing surface and downstream free axial sealing surface have a radial connection wall between them, and:

$1 \leq D1/D2 \leq 1.5$, or $1 \leq L2/L1 \leq 4$, or $1 \leq L3/L1 \leq 3$, wherein:

D1 is a radial distance between the first upstream free axial sealing surface of said at least one block and the free end of the circumferential wall, D2 is a radial distance between the free end of the circumferential wall and a radially outer face of an upstream facing spoiler, L1 is an axial thickness of the upstream labyrinth seal lip, at the free end, L2 is an axial distance between a downstream face of the circumferential wall and an upstream face, at the free end, of the upstream labyrinth seal lip, and L3 is an axial distance between a downstream face, at the free end, of the upstream labyrinth seal lip and the radial connecting wall.

2. The device according to claim 1 wherein, radially to said axis, the circumferential wall extends axially opposite a part of the upstream labyrinth seal lip located radially to said axis at a distance from the free end of said upstream labyrinth seal lip.

3. The device according to claim 1, wherein the circumferential wall is axially located at or towards an upstream end of the first upstream free axial sealing surface of the at least one block.

4. The device according to claim 2, wherein the circumferential wall is axially located at or towards an axially upstream end of the first upstream free axial sealing surface of the at least one block.

5. The device according to claim 2, wherein the circumferential wall is integral with said at least one block.

6. The device according to claim 2, wherein the circumferential wall is formed on said at least one block.

7. The device according to claim 1, wherein the upstream labyrinth seal lip is inclined towards said first upstream free axial sealing surface, upstream with respect to the axis and to a direction radial to the axis, over at least a part of a length of the upstream labyrinth seal lip.

8. The device according to claim 2, wherein the upstream labyrinth seal lip is inclined towards said first upstream free axial sealing surface, upstream with respect to the axis and to a direction radial to the axis, over at least a part of a length of the upstream labyrinth seal lip.

9. The device according to claim 1 wherein said first upstream free axial sealing surface and downstream free axial sealing surface have a radial connection wall between them.

10. The device according to claim 1, wherein:

the at least one block has a cellular structure comprising radial cells individually having an axial dimension, and the circumferential wall has an axial thickness greater than said axial dimension of the cells located on the same circumference, transversely to said axis.

11. The device according to claim 1, wherein:

the end portion of the rotor part over which said two labyrinth seal lips radially project comprises a platform provided at an upstream end with the upstream facing spoiler, and radially to the axis, the circumferential wall extends opposite, but at a distance from, the upstream facing spoiler.

12. A gas turbomachine for an aircraft, wherein it is equipped with the sealing device according to claim 1.

13. The device according to claim 3, wherein:

the end portion of the rotor part over which said two labyrinth seal lips radially project comprises a platform provided at the upstream end with an upstream facing spoiler, and radially to the axis, the circumferential wall extends opposite, but at a distance from, the spoiler.

14. The device according to claim 3, wherein the free end of the upstream labyrinth seal lip is located radially opposite an axially upstream part of the first upstream free axial sealing surface.

15. The device according to claim 1, wherein the circumferential wall projects radially with respect to the first upstream free axial sealing surface of the sealing device, which the first upstream free axial sealing surface is adjacent to the circumferential wall, axially, upstream of the circumferential wall.

16. A sealing device arranged to cooperate with a rotor part and a stator part, both of an aircraft gas turbomachine in which a gas stream is to circulate from upstream to downstream, the rotor part being adapted to rotate relative to the stator part about an axis, the sealing device comprising:

two labyrinth seal lips, respectively an upstream one and a downstream one, both being elements of the rotor parts, and, at least one block made of an abradable material:

attached to the stator part, and adapted to cooperate with said two labyrinth seal lips, each projecting radially to said axis over an end portion of the rotor part, the at least one block has, radially to said axis, an upstream free axial sealing surface and a downstream free axial sealing surface, and said two labyrinth seal lips have, radially to said axis, respective free ends, the free end of the downstream labyrinth seal lip and the downstream free axial sealing surface being located at positions radial to said axis which are each further from the axis than the free end of the upstream labyrinth seal lip and the upstream free axial sealing surface, wherein, upstream of said two labyrinth seal lips, the sealing device comprises a circumferential wall which extends radially to said axis beyond the upstream free axial sealing surface of said at least one block, by penetrating radially to said axis into the gas stream, and wherein:

the end portion of the rotor part over which said two labyrinth seal lips radially project comprises a platform provided at an upstream end with an upstream facing spoiler, and radially to the axis, the circumferential wall extends opposite, but at a distance from, the upstream facing spoiler, wherein the circumferential wall projects radially with respect to the upstream free axial sealing surface of the sealing device, which the upstream free axial sealing surface is adjacent to the circumferential wall, axially, upstream of the circumferential wall;

wherein said upstream free axial sealing surface and downstream free axial sealing surface have a radial connection wall between them, and:

$1 \leq D1/D2 \leq 1.5$, $1 \leq L2/L1 \leq 4$, $1 \leq L3/L1 \leq 3$, wherein

D1 is a radial distance between the upstream free axial sealing surface of said at least one block and the free end of the circumferential wall, D2 is a radial distance between the free end of the circumferential wall and a radially outer face of the upstream facing spoiler, L1 is an axial thickness of the upstream labyrinth seal lip 40*a*, at the free end, L2 is an axial distance between a downstream face of the circumferential wall and an upstream face, at the free end, of the upstream labyrinth seal lip, and L3 is an axial distance between a downstream face, at the free end, of the upstream labyrinth seal lip and the radial connecting wall.

* * * * *